US009337549B2

(12) United States Patent
Wu

(10) Patent No.: US 9,337,549 B2
(45) Date of Patent: May 10, 2016

(54) ANTENNA MODULE

(71) Applicant: Lynwave Technology Ltd., New Taipei (TW)

(72) Inventor: San-Yuan Wu, New Taipei (TW)

(73) Assignee: LYNWAVE TECHNOLOGY LTD., New Taipei (TW)

( * ) Notice: Subject to any disclaimer, the term of this patent is extended or adjusted under 35 U.S.C. 154(b) by 588 days.

(21) Appl. No.: 13/654,712

(22) Filed: Oct. 18, 2012

(65) Prior Publication Data

US 2013/0099992 A1 Apr. 25, 2013

(30) Foreign Application Priority Data

Oct. 19, 2011 (TW) ..... 100219607 U

(51) Int. Cl.

| | |
|---|---|
| ***H01Q 21/30*** | (2006.01) |
| ***H01Q 1/52*** | (2006.01) |
| ***H01Q 21/28*** | (2006.01) |

(52) U.S. Cl.
CPC ..... *H01Q 21/30* (2013.01); *H01Q 1/521* (2013.01); *H01Q 21/28* (2013.01)

(58) Field of Classification Search
CPC ..... H01Q 1/521; H01Q 21/28; H01Q 21/30
See application file for complete search history.

(56) References Cited

FOREIGN PATENT DOCUMENTS

WO WO2010028521 A1 * 3/2010 ..... H01Q 1/52

* cited by examiner

*Primary Examiner* — Robert Karacsony
(74) *Attorney, Agent, or Firm* — Maschoff Brennan

(57) ABSTRACT

An antenna module mainly includes at least one antenna capable of radiating signals of two frequencies, a grounding portion, and at least one isolation metal sheet capable of isolating signals of a frequency generated by different antennas from each other to avoid interference. The antenna module is integrally formed, which can reduce the volume of the antenna module, and provide a stable radiation pattern and broadband and multi-band functions.

1 Claim, 3 Drawing Sheets

ANTENNA MODULE

CROSS-REFERENCE TO RELATED APPLICATIONS

This non-provisional application claims priority under 35 U.S.C. §119(a) on patent application No(s). 100219607 filed in Taiwan, R.O.C. on Oct. 19, 2011, the entire contents of which are hereby incorporated by reference.

BACKGROUND

1. Technical Field

The disclosure relates to an antenna module, and more particularly to a broadband and multi-band antenna module having a stable radiation pattern.

2. Related Art

To connect to wireless local area network, a computer device must be electrically connected to a radio transceiver device. An electrical connection portion of the radio transceiver device generally meets the standard specification of a Universal Serial Bus (USB), and can be electrically connected to a USB port of the computer device. Therefore, at least one antenna module for receiving and transmitting radio signals needs to be built in the radio transceiver device, and preferably, the antenna module is a broadband and multi-band antenna module. However, as communication apparatuses become lighter, thinner, shorter, and smaller, the size of the antenna module also needs to be gradually reduced, resulting in the incapability of optimizing the performance of the antenna module. In order to solve the above problem, in the prior art, multiple antennas must be arranged in a communication apparatus with limited volume, which is difficult to design. Alternatively, the antenna module is manufactured outside the communication apparatus, which largely increases the volume of the radio transceiver device and does not meet the light and thin requirements of the modern communication apparatus.

On the contrary, to install the antenna module in a miniature communication apparatus and maintain the antenna performance as well, the volume of the antenna module must be limited to a certain size, and thus the operation band of the antenna module is limited, or a radiation pattern of poor stability is caused. Therefore, to design a broadband and multi-band antenna module having an omnidirectional and stable radiation pattern is one of the schemes for developing an antenna module built in a miniature communication apparatus.

SUMMARY

In view of the above, the disclosure is an antenna module that can be built in an electronic device, and more particularly a broadband and multi-band antenna module having a stable radiation pattern.

An antenna module according to an embodiment of the disclosure comprises a first antenna, a second antenna, a grounding portion, and an isolation metal sheet. The grounding portion comprises a first sub-connection portion and a second sub-connection portion. The first sub-connection portion is connected to one end of the grounding portion, the second sub-connection portion is connected to the other end of the grounding portion, the first sub-connection portion is connected to the first antenna, and the second sub-connection portion is connected to the second antenna. The first antenna and the second antenna each comprise a first radiation portion and a second radiation portion. The first radiation portion and the second radiation portion each are of a serpentine structure and used for receiving and transmitting a radio frequency signal. Each of the first radiation portions of the first antenna and the second antenna further comprises a first fixing portion. Each first fixing portion is formed by extending the first radiation portion. Each of the second radiation portions of the first antenna and the second antenna further comprises a second fixing portion. Each second fixing portion is formed by extending the second radiation portion. The first fixing portion or the second fixing portion may be used for feeding a signal. The isolation metal sheet comprises a connection portion and an isolation portion. One end of the connection portion is connected to the isolation portion, and the other end of the connection portion is formed by perpendicularly extending the grounding portion. The isolation metal sheet is used for isolating signals from the second radiation portions of the first antenna and the second antenna from each other to avoid interference.

An antenna module according to an embodiment of the disclosure comprises a first antenna, a second antenna, a third antenna, a grounding portion, a first isolation metal sheet, and a second isolation metal sheet. The grounding portion comprises a first sub-connection portion, a second sub-connection portion, and a third sub-connection portion. The first sub-connection portion of the grounding portion is connected to the first antenna, the second sub-connection portion is connected to the second antenna, and the third sub-connection portion is connected to the third antenna. The first antenna, the second antenna, and the third antenna each comprise a first radiation portion and a second radiation portion. The first radiation portion and the second radiation portion each are of a serpentine structure and used for receiving and transmitting a radio frequency signal. Each of the first radiation portions of the first antenna, the second antenna, and the third antenna further comprises a first fixing portion. Each first fixing portion is formed by extending the first radiation portion. Each of the second radiation portions of the first antenna, the second antenna, and the third antenna further comprises a second fixing portion. Each second fixing portion is formed by extending the second radiation portion. The first isolation metal sheet and the second isolation metal sheet are formed by extending the grounding portion. The first isolation metal sheet is connected between the first sub-connection portion and the second sub-connection portion and between the second sub-connection portion and the third sub-connection portion of the grounding portion at the same time. The second isolation metal sheet is connected between the first sub-connection portion and the third sub-connection portion and between the second sub-connection portion and the third sub-connection portion at the same time.

An antenna module according to an embodiment of the disclosure comprises a first antenna, a second antenna, a third antenna, a grounding portion, a first isolation metal sheet, a second isolation metal sheet, and a third isolation metal sheet. The grounding portion comprises a first sub-connection portion, a second sub-connection portion, and a third sub-connection portion. The first sub-connection portion is connected to the first antenna, the second sub-connection portion is connected to the second antenna, and the third sub-connection portion is connected to the third antenna. The first antenna, the second antenna, and the third antenna each comprise a first radiation portion and a second radiation portion. The first radiation portion and the second radiation portion each are of a serpentine structure and used for receiving and transmitting a radio frequency signal. Each of the first radiation portions of the first antenna, the second antenna, and the third antenna further comprises a first fixing portion. Each first fixing portion is formed by extending the first radiation portion. Each of the second radiation portions of the first antenna, the second antenna, and the third antenna further comprises a second fixing portion. Each second fixing portion is formed by extending the second radiation portion. The first isolation metal sheet, the second isolation metal sheet, and the third isolation metal sheet are formed by extending the grounding portion. The first isolation metal sheet is connected between the second sub-connection portion and the third sub-connection portion of the grounding portion. The second isolation metal sheet is connected between the first sub-connection portion and the second sub-connection portion. The third isolation metal sheet is connected between the first sub-connection portion and the third sub-connection portion.

According to the structure of the antenna module in the disclosure, two radiation portions are provided and antennas are arranged in all directions to transmit signals, so that the volume of the antenna module and the electronic device can be greatly reduced, and the stable radiation pattern and broadband and multi-band requirements can be met.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

The detailed features and advantages of the disclosure are described below in great detail through the following embodiments, and the content of the detailed description is sufficient for persons skilled in the art to understand the technical content of the disclosure and to implement the disclosure accordingly. Based upon the content of the specification, the claims, and the drawings, persons skilled in the art can easily understand the relevant objectives and advantages of the disclosure. The following embodiments are intended to describe the disclosure in further detail, but not intended to limit the scope of the disclosure in any way.

Figure 1:
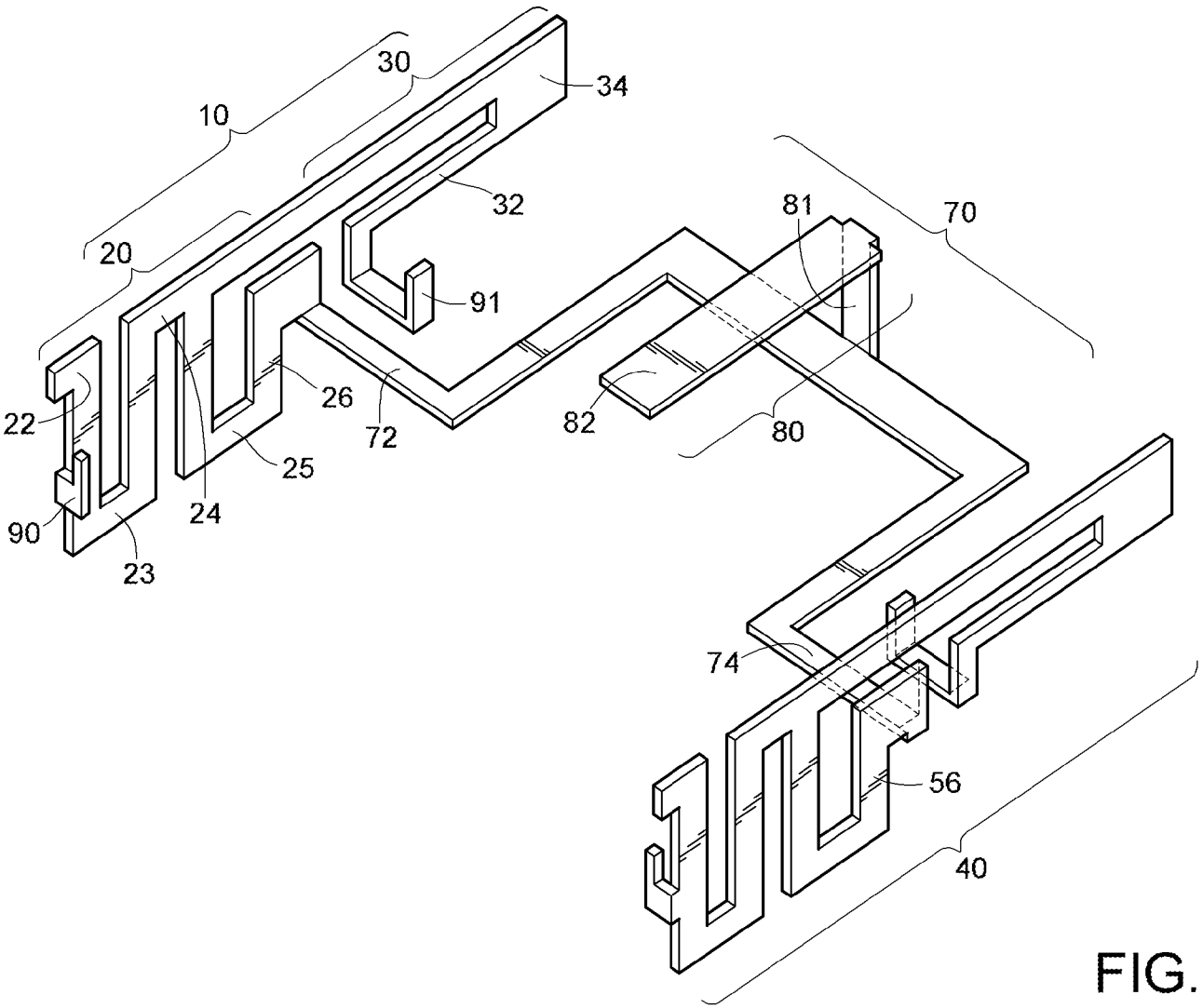
FIG. 1 shows an antenna module according to a first embodiment of the disclosure.

FIG. 1 is a schematic structural view of an antenna module according to a first embodiment of the disclosure. The structure shown in this figure is formed of a piece of conductive material, for example, metal. For the convenience of description, the antenna module is disassembled into a plurality of components.

The antenna module according to the first embodiment of the disclosure comprises a first antenna 10, a second antenna 40, a grounding portion 70, and an isolation metal sheet 80. The first antenna 10 comprises a first radiation portion 20 and a second radiation portion 30. An overall structure of the second antenna 40 is the same as that of the first antenna 10, so the reference numbers of structures in the second antenna 40 are omitted and replaced with those of the first antenna 10. Therefore, the first embodiment of the disclosure is described mainly by taking an example that the first antenna 10 is disassembled into a plurality of components. The grounding portion 70 of the antenna in the first embodiment of the disclosure comprises a first sub-connection portion 72 and a second sub-connection portion 74. The first sub-connection portion 72 is located at one end of the grounding portion 70, and the second sub-connection portion 74 is located at the other end of the grounding portion 70. The first sub-connection portion 72 is connected to the first antenna 10, and the second sub-connection portion 74 is connected to the second antenna 40. The isolation metal sheet 80 comprises a connection portion 81 and an isolation portion 82. One end of the connection portion 81 is connected to the isolation portion 82, and the other end of the connection portion 81 is connected to the grounding portion 70. The connection portion 81 of the isolation metal sheet 80 is formed by perpendicularly extending the grounding portion 70. The isolation metal sheet 80 is used for isolating signals generated by the first antenna 10 and the second antenna 40 from each another, to avoid interference.

The first antenna 10 comprises the first radiation portion 20, the second radiation portion 30, a first fixing portion 90, and a second fixing portion 91. The first radiation portion 20 is of a serpentine structure formed by a U-shaped section and a plurality of L-shaped sections, comprising a first L-shaped section 22, a second L-shaped section 26, and a U-shaped section 24. The first radiation portion 20 of the first antenna 10 further has a first radiation connection section 23 connected between the first L-shaped section 22 and the U-shaped section 24 and a second radiation connection section 25 connected between the U-shaped section 24 and the second L-shaped section 26. The second L-shaped section 26 of the first antenna 10 is connected to the first sub-connection portion 72 of the grounding portion 70, and a second L-shaped section 56 of the second antenna 40 is connected to the second sub-connection portion 74 of the grounding portion 70. The shape and size of the first L-shaped section 22 may be the same as or different from those of the second L-shaped section 26. Each of the second radiation portions 30 of the first antenna 10 and the second antenna 40 comprises a first L-shaped section 32 and a second L-shaped section 34. The second L-shaped section 34 is connected between the first L-shaped section 32 and the U-shaped section 24 of the first radiation portion 20. The shape and size of the first L-shaped section 32 may be the same as or different from those of the second L-shaped section 34. The first fixing portion 90 and the second fixing portion 91 may each be of an L-shaped structure. The first fixing portion 90 may be formed by perpendicularly extending the first L-shaped section 22 of the first radiation portion 20 of the first antenna 10, and the second fixing portion 91 may be formed by perpendicularly extending an end of the first L-shaped section 32 in the second radiation portion 30 of the first antenna 10. The first fixing portion 90 and the second fixing portion 91 help to fix the antenna in an electronic device, and the first fixing portion 90 or the second fixing portion 91 may be selected as a signal feeding point. The numbers and shapes of the U-shaped sections, the radiation connection sections and the L-shaped sections in the first antenna 10 and the second antenna 40 of this embodiment are not intended to limit the scope of the disclosure and can be designed according to an actual application.

Figure 2:
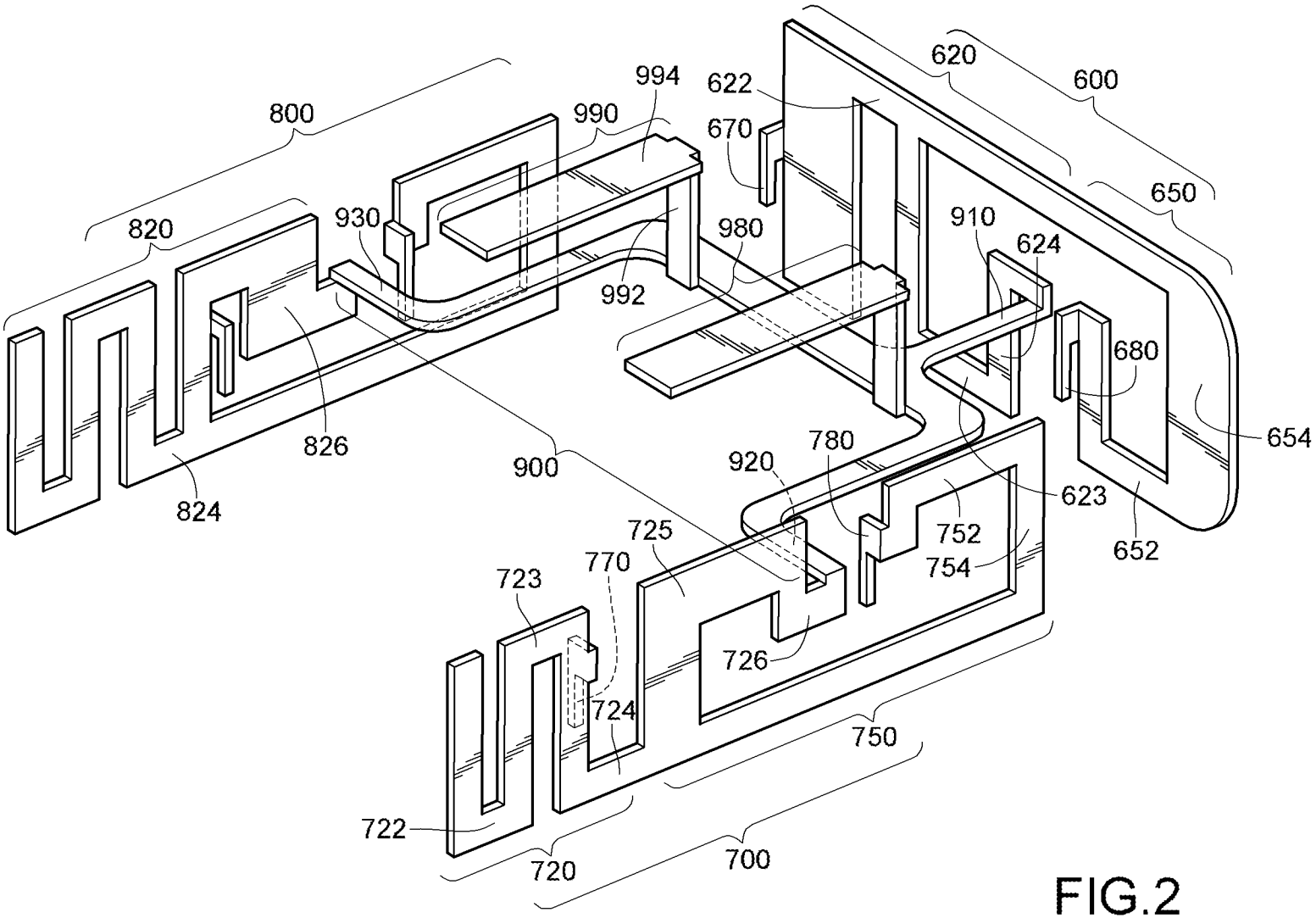
FIG. 2 shows an antenna module according to a second embodiment of the disclosure.

FIG. 2 is a schematic structural view of an antenna module according to a second embodiment of the disclosure. The structure shown in this figure is integrally formed of a conductive material, for example, metal. For the convenience of description, the antenna module is disassembled into a plurality of components for description.

The antenna module according to the second embodiment of the disclosure comprises a first antenna 600, a second antenna 700, a third antenna 800, a grounding portion 900, a first isolation metal sheet 980, and a second isolation metal sheet 990. The first antenna 600 comprises a first radiation portion 620 and a second radiation portion 650, and the second antenna 700 comprises a first radiation portion 720 and a second radiation portion 750. In this embodiment, an overall structure of the third antenna 800 is similar to that of the second antenna 700, so that most of reference numbers of the third antenna 800 are omitted. Therefore, this embodiment of the disclosure is described mainly by taking an example that the first antenna 600 and the second antenna 700 are disassembled into a plurality of components. The grounding portion 900 comprises a first sub-connection portion 910, a second sub-connection portion 920, and a third sub-connection portion 930. The first sub-connection portion 910 is connected to the first antenna 600, the second sub-connection portion 920 is connected to the second antenna 700, and the third sub-connection portion 930 is connected to the third antenna 800. The first isolation metal sheet 980 and the second isolation metal sheet 990 of this embodiment are used for isolating signals generated by the first antenna 600, the second antenna 700, and the third antenna 800 from each other, to avoid interference.

The first antenna 600 comprises the first radiation portion 620, the second radiation portion 650, a first fixing portion 670, and a second fixing portion 680. The first radiation portion 620 comprises a U-shaped section 622, an L-shaped section 624, and a radiation connection section 623. The radiation connection section 623 is connected between the U-shaped section 622 and the L-shaped section 624. The L-shaped section 624 is connected to the first sub-connection portion 910 of the grounding portion 900. The sub-sections of the U-shaped section 622 may have the same width, or the width of a certain sub-section is greater than the width of another sub-section. The second radiation portion 650 comprises a first L-shaped section 652 and a second L-shaped section 654. The second L-shaped section 654 is connected between the first L-shaped section 652 and the U-shaped section 622 of the first radiation portion 620. The shape and size of the first L-shaped section 652 may be the same as or different from those of the second L-shaped section 654. The first fixing portion 670 and the second fixing portion 680 may each be of an L-shaped structure. The first fixing portion 670 may be formed by perpendicularly extending the U-shaped section 622 of the first radiation portion 620 of the first antenna 600, and the second fixing portion 680 may be formed by perpendicularly extending an end of the first L-shaped section 652 in the second radiation portion 650 of the first antenna 600.

The second antenna 700 and the third antenna 800 each comprise the first radiation portion 720, the second radiation portion 750, a first fixing portion 770, and a second fixing portion 780. The first radiation portion 720 is of a serpentine structure formed by a plurality of U-shaped sections and an L-shaped section, comprising a first U-shaped section 722, a second U-shaped section 724, and an L-shaped section 726. The second antenna 700 further comprises a first radiation connection section 723 connected between the first U-shaped section 722 and the second U-shaped section 724 and a second radiation connection section 725 connected between the second U-shaped section 724 and the L-shaped section 726. The third antenna 800 also has a similar structure. The L-shaped section 726 of the second antenna 700 is connected to the second sub-connection portion 920 of the grounding portion 900, and the L-shaped section 826 of the third antenna 800 is connected to the third sub-connection portion 930 of the grounding portion 900. The shape and size of the first U-shaped section 722 may be the same as or different from those of the second U-shaped section 724. The shapes of the second U-shaped section 724 and the L-shaped section 726 of the first radiation portion 720 of the second antenna 700 may be the same as or different from the shapes of the second U-shaped section 824 and the L-shaped section 826 of the first radiation portion 820 of the third antenna 800. The second radiation portion 750 further comprises a first L-shaped section 752 and a second L-shaped section 754. The second L-shaped section 754 is connected between the first L-shaped section 752 and the second U-shaped section 724 of the first radiation portion 720. The first fixing portion 770 and the second fixing portion 780 may each be of an L-shaped structure. The first fixing section 770 may be formed by perpendicularly extending the second U-shaped section 724 of the first radiation portion 720 of the second antenna 700, and the second fixing portion 780 may be formed by perpendicularly extending an end of the first L-shaped section 752 in the second radiation portion 750 of the second antenna 700. The first fixing portion and the second fixing portion in each of the first antenna 600, the second antenna 700, and the third antenna 800 of this embodiment help to fix the antenna in an electronic device, and the first fixing portion or the second fixing portion may be selected as a signal feeding point. The numbers and shapes of the U-shaped sections, the radiation connection sections and the L-shaped sections of this embodiment are not intended to limit the scope of the disclosure and can be designed according to an actual application.

In the second embodiment of the disclosure, the antenna module further comprises the first isolation metal sheet 980 and the second isolation metal sheet 990. Each isolation metal sheet further comprises a connection portion 992 and an isolation portion 994. One end of the connection portion 992 is connected to the isolation portion 994, and the other end of the connection portion 992 is formed by perpendicularly extending the grounding portion 900. The first isolation metal sheet 980 is located between the first sub-connection portion 910 and the second sub-connection portion 920 and between the second sub-connection portion 920 and the third sub-connection portion 930 of the grounding portion 900 at the same time, and the second isolation metal sheet 990 is located between the first sub-connection portion 910 and the third sub-connection portion 930 and between the second sub-connection portion 920 and the third sub-connection portion 930 of the grounding portion 900 at the same time. In other embodiments, the numbers, shapes and connection positions of the isolation metal sheets may be designed according to an actual application.

Figure 3:
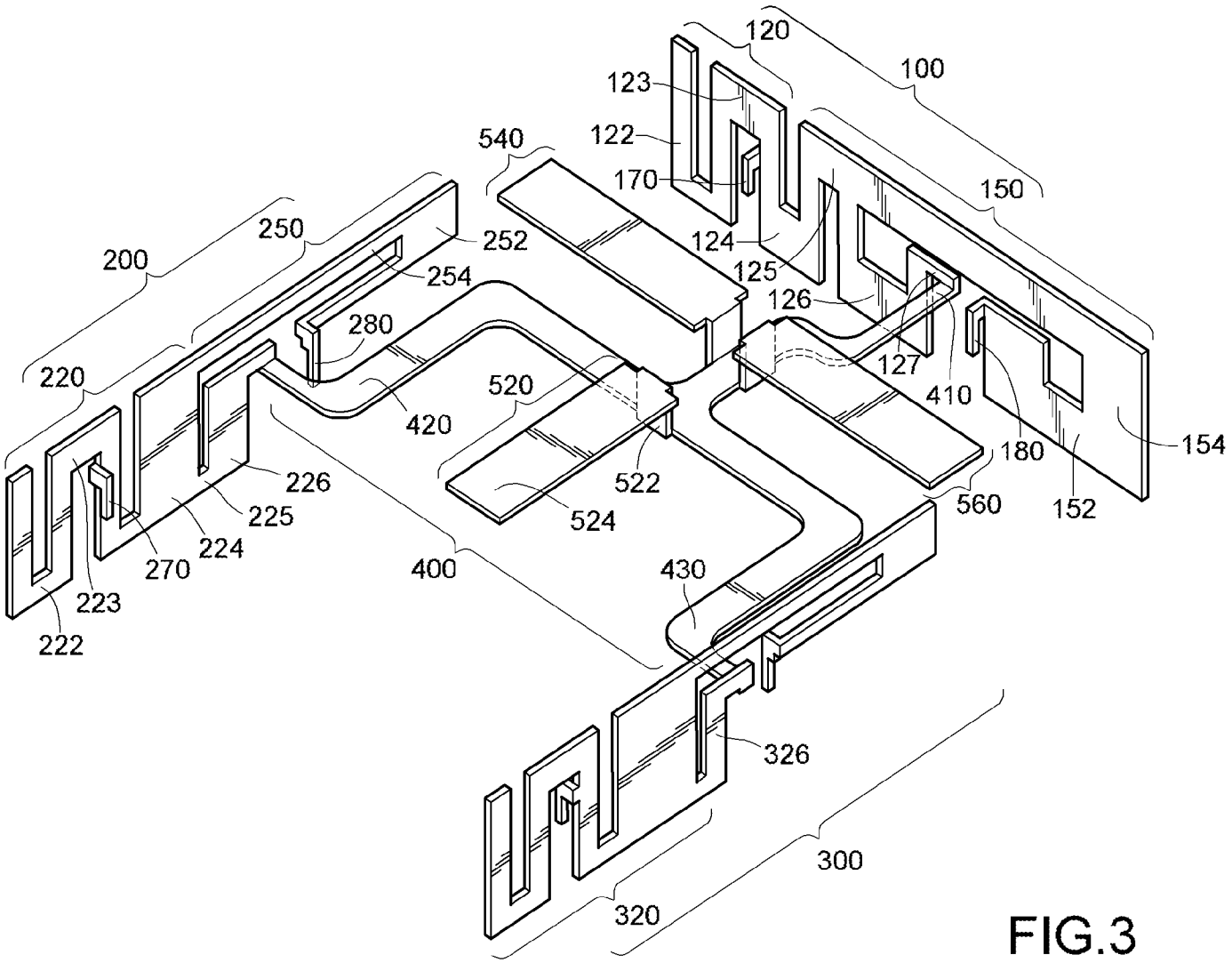
FIG. 3 shows an antenna module according to a third embodiment of the disclosure.

FIG. 3 is a schematic structural view of an antenna module according to a third embodiment of the disclosure. The structure shown in this figure is integrally formed of a conductive material, for example, metal. For the convenience of description, an antenna is disassembled into a plurality of components for description.

The antenna module according to the third embodiment of the disclosure comprises a first antenna 100, a second antenna 200, a third antenna 300, a grounding portion 400, a first isolation metal sheet 520, a second isolation metal sheet 540, and a third isolation metal sheet 560. The first antenna 100 comprises a first radiation portion 120 and a second radiation portion 150, and the second antenna 200 comprises a first radiation portion 220 and a second radiation portion 250. An overall structure of the third antenna 300 is the same as that of the second antenna 200, so that most of reference numbers of the third antenna 300 are omitted. Therefore, this embodiment of the disclosure is described mainly by taking an example that the first antenna 100 and the second antenna 200 are disassembled into a plurality of components. The grounding portion 400 of the antenna of this embodiment comprises a first sub-connection portion 410, a second sub-connection portion 420, and a third sub-connection portion 430. The first sub-connection portion 410 is connected to the first antenna 100, the second sub-connection portion 420 is connected to the second antenna 200, and the third sub-connection portion 430 is connected to the third antenna 300. The first isolation metal sheet 520, the second isolation metal sheet 540, and the third isolation metal sheet 560 are used for isolating signals generated by the first antenna 100, the second antenna 200, and the third antenna 300 from each other, to avoid interference.

The first antenna 100 comprises the first radiation portion 120, the second radiation portion 150, a first fixing portion 170, and a second fixing portion 180. The first radiation portion 120 is of a serpentine structure formed by a plurality of U-shaped sections, comprising a first U-shaped section 122, a second U-shaped section 124, and a third U-shaped section 126. The first radiation portion 120 of the first antenna 100 further comprises a first radiation connection section 123 connected between the first U-shaped section 122 and the second U-shaped section 124, a second radiation connection section 125 connected between the second U-shaped section 124 and the third U-shaped section 126, and a third radiation connection section 127 connected between the third U-shaped section 126 and the first sub-connection portion 410 of the grounding portion 400. The shapes and sizes of the first U-shaped section 122, the second U-shaped section 124, and the third U-shaped section 126 may be the same as or different from each other. The second radiation portion 150 of the first antenna 100 comprises a first L-shaped section 152 and a second L-shaped section 154. The second L-shaped section 154 is connected between the first L-shaped section 152 and the second radiation connection section 125 of the first radiation portion 120. The shape and size of the first L-shaped section 152 may be the same as or different from those of the second L-shaped section 154. The first fixing portion 170 and the second fixing portion 180 may each be of an L-shaped structure. The first fixing section 170 may be formed by perpendicularly extending the second U-shaped section 124 of the first radiation portion 120 of the first antenna 100, and the second fixing portion 180 is formed by perpendicularly extending an end of the first L-shaped section 152 in the second radiation portion 150 of the first antenna 100.

The second antenna 200 and the third antenna 300 each comprise the first radiation portion 220, the second radiation portion 250, a first fixing portion 270, and a second fixing portion 280. The first radiation portion 220 is of a serpentine structure formed by a plurality of U-shaped sections and an L-shaped section, comprising a first U-shaped section 222, a second U-shaped section 224, and an L-shaped section 226. The first radiation portion 220 of the second antenna 200 further comprises a first radiation connection section 223 connected between the first U-shaped section 222 and the second U-shaped section 224, and a second radiation connection section 225 connected between the second U-shaped section 224 and the L-shaped section 226. The third antenna 300 also has a similar structure. The L-shaped section 226 of the second antenna 200 is connected to the second sub-connection portion 420 of the grounding portion 400, and the L-shaped section 326 of the third antenna 300 is connected to the third sub-connection portion 430 of the grounding portion 400. The shape and size of the first U-shaped section 222 may be the same as or different from those of the second U-shaped section 224. The shape of the L-shaped section 226 of the first radiation portion 220 of the second antenna 200 may be the same as or different from the shape of the L-shaped section 326 of the first radiation portion 320 of the third antenna 300. The second radiation portion 250 further comprises an L-shaped section 252 and a radiation connection section 254. The radiation connection section 254 is connected between the L-shaped section 252 and the second U-shaped section 224 of the first radiation portion 220. The first fixing portion 270 and the second fixing portion 280 may each be of an L-shaped structure. The first fixing section 270 may be formed by perpendicularly extending the second U-shaped section 224 of the first radiation portion 220 of the second antenna 200, and the second fixing portion 280 may be formed by perpendicularly extending an end of the L-shaped section 252 in the second radiation portion 250 of the second antenna 200. The first fixing portion and the second fixing portion in each of the first antenna 100, the second antenna 200, and the third antenna 300 of this embodiment help to fix the antenna in an electronic device, and the first fixing portion or the second fixing portion may be selected as a signal feeding point. In addition, the disclosure is not limited to the first fixing portion and the second fixing portion in each of the first antenna 100, the second antenna 200, and the third antenna 300 of this embodiment, which means these fixing portions are optional. It is understood by people skilled in the art that any configuration which is able to fix the antenna in the electronic device falls within the scope of the embodiments of the disclosure. The numbers and shapes of the U-shaped sections, the radiation connection sections and the L-shaped sections of the first antenna 100, the second antenna 200, and the third antenna 300 of this embodiment are not intended to limit the scope of the disclosure and can be designed according to an actual application. In such a case, the numbers and shapes of the first radiation portion and the second radiation portion in each of the first antenna 100, the second antenna 200, and the third antenna 300 of this embodiment are not intended to limit the scope of the disclosure and can be designed according to an actual application. Thus, the radiation connection sections connected between U-shaped sections, the radiation connection sections and the L-shaped sections are not intended to limit the scope of the disclosure.

In the third embodiment of the disclosure, the antenna module further comprises the first isolation metal sheet 520, the second isolation metal sheet 540, and the third isolation metal sheet 560. Each isolation metal sheet further comprises a connection portion 522 and an isolation portion 524. One end of the connection portion 522 is connected to the isolation portion 524, and the other end of the connection portion 522 is formed by perpendicularly extending the grounding portion 400. The first isolation metal sheet 520 is located between the second sub-connection portion 420 and the third sub-connection portion 430 of the grounding portion 400, the second isolation metal sheet 540 is located between the first sub-connection portion 410 and the second sub-connection portion 420 of the grounding portion 400, and the third isolation metal sheet 560 is located between the first sub-connection portion 410 and the third sub-connection portion 430 of the grounding portion 400. The structures of the first isolation metal sheet 520, the second isolation metal sheet 540, and the third isolation metal sheet 560 are not limited to the configuration of the connection portion 522 and the isolation portion 524. It is understood by people skilled in the art that the isolation metal sheet which is formed by extending the grounding portion 400 falls within the scope of the embodiments of the disclosure.

To sum up, the structure of the antenna module in the disclosure is an integrated structure that can be formed by directly bending a single metal plate, and provided with antennas arranged in all directions and different radiation portions. Therefore, the volume of the antennas can be greatly reduced to be adapted in an electronic device, and a stable radiation pattern and good radio signal receiving/transmitting capabilities can be achieved.

What is claimed is:

1. An antenna module, comprising:

a first antenna;

a second antenna;

a third antenna, the first antenna, the second antenna, and the third antenna each comprising:

a first radiation portion, and a second radiation portion, the first radiation portion and the second radiation portion each being of a serpentine structure and used for receiving and transmitting a radio frequency signal;

a grounding portion, comprising a first sub-connection portion and a second sub-connection portion, and a third sub-connection portion, the first sub-connection portion being connected to the first antenna, the second sub-connection portion being connected to the second antenna, and the third sub-connection portion being connected to the third antenna; and a first isolation metal sheet, a second isolation metal sheet, and a third isolation metal sheet, each used for isolating the second radiation portions of the first antenna, the second antenna, and the third antenna from one another, and formed by extending the grounding portion, wherein the first radiation portion of the first antenna further comprises a first U-shaped section, a second U-shaped section, a third U-shaped section, a first radiation connection section, a second radiation connection section, and a third radiation connection section, the first radiation connection section being connected between the first U-shaped section and the second U-shaped section, the second radiation connection section being connected between the second U-shaped section and the third U-shaped section, and the third radiation connection section being connected between the third U-shaped section and the first sub-connection portion of the grounding portion;

wherein the second radiation portion of the first antenna comprises a first L-shaped section and a second L-shaped section, the second L-shaped section being connected between the first L-shaped section and the second radiation connection section of the first radiation portion;

wherein each of the first radiation portions of the second antenna and the third antenna comprises a first U-shaped section, a second U-shaped section, an L-shaped section, a first radiation connection section, and a second radiation connection section, the first radiation connection section being connected between the first U-shaped section and the second U-shaped section, the second radiation connection section being connected between the second U-shaped section and the L-shaped section, the L-shaped section of the second antenna being connected to the second sub-connection portion of the grounding portion, and the L-shaped section of the third antenna being connected to the third sub-connection portion of the grounding portion;

wherein each of the second radiation portions of the second antenna and the third antenna further comprises an L-shaped section and a radiation connection section, each of the radiation connection sections being connected between the L-shaped section and the second U-shaped section of the first radiation portion;

wherein the first antenna, the second antenna, and the third antenna each further extend to form a first fixing portion and a second fixing portion;

wherein the first isolation metal sheet, the second isolation metal sheet, and the third isolation metal sheet each comprise a connection portion and an isolation portion, one end of the connection portion being connected to the isolation portion, and the other end of the connection portion being formed by extending the grounding portion of the antenna module;

wherein the first isolation metal sheet is located between the second sub-connection portion and the third sub-connection portion of the grounding portion, the second isolation metal sheet is located between the first sub-connection portion and the second sub-connection portion of the grounding portion, and the third isolation metal sheet is located between the first sub-connection portion and the third sub-connection portion.

* * * * *